US006327820B1

(12) United States Patent
Picco

(10) Patent No.: US 6,327,820 B1
(45) Date of Patent: Dec. 11, 2001

(54) KIT OF ELEMENTS AND A METHOD OF USING THE KIT FOR FLASHING A ROOF-PENETRATING ELEMENT

(75) Inventor: Vincenzo Picco, Helsingør (DK)

(73) Assignee: VKR Holding A/S, Soborg (DK)

( * ) Notice: Subject to any disclaimer, the term of this patent is extended or adjusted under 35 U.S.C. 154(b) by 0 days.

(21) Appl. No.: 09/530,103

(22) PCT Filed: Nov. 10, 1998

(86) PCT No.: PCT/DK98/00484

§ 371 Date: Apr. 25, 2000

§ 102(e) Date: Apr. 25, 2000

(87) PCT Pub. No.: WO99/27211

PCT Pub. Date: Jun. 3, 1999

(30) Foreign Application Priority Data

Nov. 10, 1997 (DK) ..... 1997 01272

(51) Int. Cl.[7] ..... E04D 1/36
(52) U.S. Cl. ..... 52/58; 52/59; 52/60
(58) Field of Search ..... 52/58, 60, 59

(56) References Cited

U.S. PATENT DOCUMENTS 5,018,333 * 5/1991 Bruhm ..... 52/741
5,077,943 * 1/1992 McGady ..... 52/58
5,605,019 * 2/1997 Maziekien et al. ..... 52/58
5,706,610 * 1/1998 Mayle ..... 52/60
5,983,592 * 11/1999 Mayle ..... 52/746.11
6,199,326 * 3/2001 Mayle ..... 52/58

FOREIGN PATENT DOCUMENTS

3603303-A1 * 6/1987 (DE) .
98982 * 6/1984 (DK) .

OTHER PUBLICATIONS

Internation Search Report, PCT/DK 98/00484, Jan. 1999.*

* cited by examiner

*Primary Examiner*—Carl D. Friedman
*Assistant Examiner*—Dennis L. Dorsey
(74) *Attorney, Agent, or Firm*—Venable; John P. Shannon; Chad C. Anderson

(57) ABSTRACT

The kit is made from sheet material for flashing a quadrangular roof-penetrating element, for instance a window (4), in an inclined roof (5) with a substantially plane surface, which material comprises a first element (1) with two through cuts (6) extending convergingly from the ends of a first line segment ($L_1$) to an edge (7) of this element (1), a second element **(2*a*) with two through cuts (11, 12), which cuts extend from each end of a second line segment ($L_2$) obliquely to an edge (13) of the element (2*a*) under formation of an acute angle ($V_{21}$) with the line segment ($L_2$) and obliquely or straight to an edge (14) of the element (2*a*) under formation of an obtuse or straight angle ($V_{22}$) with the line segment ($L_2$), respectively, an element (2*b*) mirror-inverted relative to the second element (2*a*), a third element (3) with two through cuts (19), which elements extends from each end of a third line segment ($L_3$) extends to each their respective edge (20) of the element (3)** under formation of an obtuse or straight angle ($V_3$) with the line segment ($L_3$).

8 Claims, 4 Drawing Sheets

KIT OF ELEMENTS AND A METHOD OF USING THE KIT FOR FLASHING A ROOF-PENETRATING ELEMENT

BACKGROUND OF THE INVENTION

The present invention relates to a kit of elements of sheet material for flashing a quadrangular roof-penetrating element, for instance a window, a chimney, a ventilating duct or the like, in an inclined roof with a substantially plane surface, which material comprises one side suited for fastening to the roof surface by gluing, adhesion, welding or the like and a second weather-proof side.

The invention further relates to a method for flashing a quadrangular roof penetrating element, for instance a window, a chimney, a ventilating duct or the like, in an inclined roof with a substantially plane surface, in particular made from concrete, by means of a kit of elements of the type mentioned above.

Danish patent No. 98982 discloses a "method for flashing corners on chimneys, dome light frames and the like protrusions on roofs with roofing felt and a bituminous sheet for use in such flashing". According to this publication, the corners of the protrusion (the roof penetrating element) are first covered by means of small textile reinforced bituminous sheets which are slit for the formation of flaps which are bent and melted together to form closed corners, following which bituminous felt sheets are mounted, said sheets extending on the sides of the roof penetrating elements forward to but not around the corners. It is said in this patent that it is known to use roofing felt strips extending from the roof surface and somewhat upwards along a side surface of the roof penetrating element, in which the part of the roofing felt extending upwards along the vertical surface at its edge is bent around the edge, a splitting of the strip being made until the place, where the vertical edge meets the roof surface.

The above-mentioned method is further known from a working instruction from the firm Icopal. From the same working instruction it is known, on basis of a measurement of the dimensions of the roof penetrating elements, to cut elements from roofing felt, whereby cuts are made at the ends of some of the elements, said cuts extending in extension of premeditated folding lines, to make it possible to fold end portions of bent up portions of the elements around the corners of the roof penetrating element.

SUMMARY OF THE INVENTION

The object of the invention is to provide a kit of elements and a method for flashing a roof-penetrating element, said kit of elements facilitating the flashing and ensuring to a high extent that the finished flashing becomes impermeable to rainwater and the like.

This object is met by means of a kit of elements comprising

- a first element with two through cuts extending convergingly from the ends of a first line segment to one edge of this element,
- a second element with two through cuts, which cuts extend from each end of a second line segment obliquely to an edge of the element under formation of an acute angle with the line segment and obliquely or straight to an edge of the element under formation of an obtuse or straight angle with the line segment, respectively,
- an element mirror-inverted relative to the second element,
- a third element with two through cuts, which extend from each their end of a third line segment to each their respective edge of the element under formation of an obtuse or straight angle with the line segment.

In this way a kit of elements is provided which, when mounted, forms a collar around the roof penetrating element, wherein the joints between the various overlappings are facing downwards such that water on the roof will tend to run away from and not into the joints.

The first and the third element are preferably symmetrical about the half-line normals of the respective line segments, at least in respect of the cuts and the folding lines, and the four elements are preferably rectangular. This provides for easy and economical production of the elements. One or more of the elements, and in particular the second one and the element mirror-inverted relative thereto, may be divided in smaller elements transversely to their respective line segments, the smaller elements overlapping one another when mounted.

It should be understood that by the element mirror-inverted relative to the second element is meant an element having two through cuts corresponding to the through cuts in the second element, in which the angles that the cuts form with the line segment of the mirror-inverted element do not have to be identical with the angles formed by the cuts in the second element. Likewise, the outer dimensions of the mirror-inverted element do not have to be identical with the dimensions of the second element.

Said acute angles are preferably approximately 45°, the tolerance being high.

In an embodiment of the kit intended for use in flashing of several adjacent roof penetrating elements, for instance windows, the kit comprises an element with two halves, one half of which constitutes a first element, and the second half of which constitutes a third element, and/or an element with two halves, one half of which constitutes a second element, and the second half being mirror-inverted relative thereto. These further elements are used between the adjacent windows depending on whether they are placed above/below or next to one another. The kit will in this case be supplemented with further first, second mirror-inverted, and third elements according to need.

The object of the invention is further met by a method which is characterized in that

- the first element is bent along the first line segment and along lines extending under 90° from the end of the line segment to the same side as the cuts, that the upwards bent portions are secured to upwards extending side surfaces of the roof penetrating element, the portion positioned between the converging cuts being secured to a downwards facing side surface, following which the remaining portions of the element are fastened by gluing, adhesion, welding or the like to the roof surface,
- that the second element is bent along the second line segment and along a line which under an angle of 90° extends from the same end of the line segment and to the same side as the cut forming an acute angle, that the upwards bent portions are secured to side surfaces of the roof penetrating element, the portion positioned along the second line segment being secured to a second side surface adjacent to the downwards facing side surface and the portion forming an acute angle being placed on top, and the lower end of the portion positioned along the second line segment being bent towards and secured to the downwards facing side surface of the roof penetrating element, following which the remaining portions of the element are fastened by gluing, adhesion, welding or the like to the roof surface, that the element mirror-inverted relative to the second element is fastened in a similar manner, and that the third element is bent along the third line segment, that the upwards bent portion is secured to the upwards facing side surface of the roof penetrating element and that the end portions of the upwards bent portion are bent around and secured to the second side surfaces, following which the remaining portions of the element are secured by gluing, adhesion, welding or the like to the roof surface.

The new and characteristic of this method is in particular that the elements are first secured on the side surfaces of the roof penetrating element, which is easily done with the elements according to the invention, whereafter the elements thus secured are fastened to the roof surface without any risk of displacement.

The method is in particular suitable in connection with concrete roofs, where the elements are directly fastened to the concrete surface and not to a previously laid out roofing felt, as is for instance known from the above working instruction.

BRIEF DESCRIPTION OF THE DRAWINGS

The invention will now be described in detail in the following by means of an example of an embodiment with reference to the schematic drawing, in which FIGS. 4 and 5 show the same window frame seen in perspective from another point above the roof, above the window, FIG. 6 a combined first and third element, and FIG. 7 a combined second element mirror-inverted relative thereto.

DETAILED DESCRIPTION OF THE INVENTION

Figure 1:
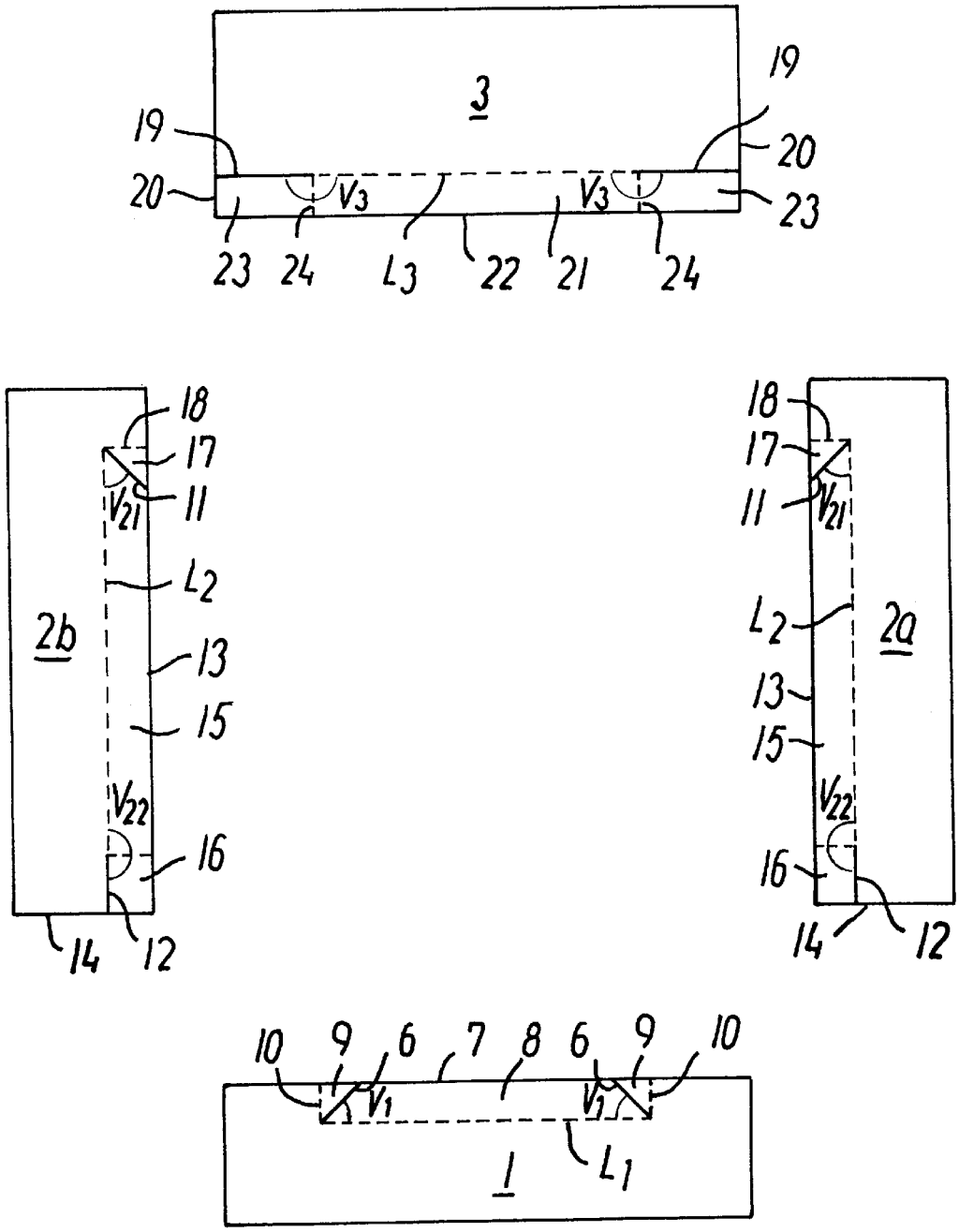
FIG. 1 shows four elements for a kit.

FIG. 1 shows four elements 1, 2*a*, 2*b*, 3 of a roofing felt material intended for mounting below, to the right of, to the left of and above a roof penetrating element to establish a tight connection between a roof surface and the roof penetrating element.

FIGS. 2–5 show a roof penetrating element in the form of a window frame 4 extending through a roof surface 5, in which by means of the elements 1, 2*a*, 2*b*, 3 a flashing is to be provided to form a sealing between the window frame 4 and the roof surface 5 to ensure that water on the roof surface 5 does not penetrate into the underlying building structure.

The elements 1, 2*a*, 2*b* and 3 may for instance be made from Icopal Base 550®, which comprises three layers: an upper cover layer of sanded SBS bitumen, a reinforcing layer placed in the middle of SBS bitumen impregnated polyester felt combined with glass felt and a lower extra thick layer of weldable SBS bitumen. This product has turned out to be particularly suitable in connection with the invention, but other products with similar properties may be utilized.

The four elements are designed as follows:

The element 1 has two through cuts 6 extending convergingly from each end of a line segment $L_1$ to one side edge 7 of the element 1. Thereby, an elongate flap 8 is provided, said flap extending along the line segment $L_1$, and two side flaps 8 extending between each their respective cut 6 and a line 10 extending from the end point of the line segment $L_1$ perpendicular thereto. The cuts 6 extend under an acute angle $V_1$ relative to the line segment $L_1$, $V_1$ being suitably 45°, but the concrete angle is of less importance provided it is acute and neither close to 0 or 90°.

The elements 2*a* and 2*b* are, in the embodiment shown, designed mirror-invertedly relative to each other and have each two through cuts 11, 12 extending from respective end points of a line segment $L_2$. The cut 11 extends under an acute angle $V_{21}$ relative to the line segment $L_2$ to a longitudinal side edge 13 of the element 2*a*, 2*b*, whereas the cut 12 extends under a substantially straight angle $V_{22}$ from one end of the line segment $L_2$ to a short side edge 14 of the element 2*a*, 2*b*. In this way an elongate flap 15 is provided, said flap extending along the line $L_2$, and an end flap 16 which per se is constituted of the end portion of the elongate flap 15 and extends from the end point of the line segment $L_2$ to the short side edge 14, the end flap being at the mounting folded around a folding line extending substantially perpendicular to the line segment $L_2$, as will be seen later. Moreover, a side flap 17 is provided between the cut 11 and a line 18 extending perpendicular to the line segment $L_2$ from its end point at the cut 11.

The element 3 also comprises two through cuts 19, each extending from an end point of a line segment $L_3$ under a substantially straight angle $V_3$ to each their respective short side edge 20 of the element 3. In this way an elongate flap 21 is provided, said flap extending between the line segment $L_3$ and a longitudinal side edge 22 of the element 3. Moreover, two end flaps 23 are provided, said flaps extending from each their respective end point of the line segment $L_3$ to the adjacent short side edge 20, the end portions of the elongate flap 21 being at the mounting folded along lines 24 extending substantially perpendicular from each their respective end points of the line segment $L_3$, as will be seen below.

Both the element 1 and the element 3 are in the embodiment shown designed symmetrically around the half-line normal to the respective line segment $L_1$, $L_3$, and all the elements 1, 2*a*, 2*b*, 3 are rectangular. Other shapes will, however, also be possible, and will in particular be of interest in connection with flashing of several adjacent windows, where the outer dimensions of the elements will be asymmetric as will be known from other types of flashing.

Figure 2:
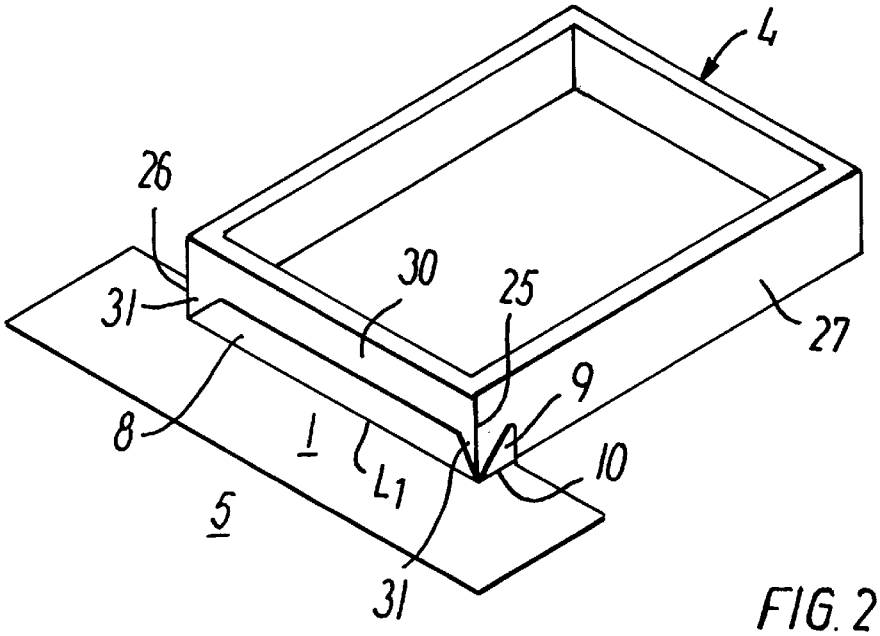
FIGS. 2–5 illustrate the mounting of the kit in connection with flashing of a roof penetrating element, FIGS. 2 and 3 showing a window frame in a roof surface seen in perspective from a point above the roof, below the window.
Figure 3:
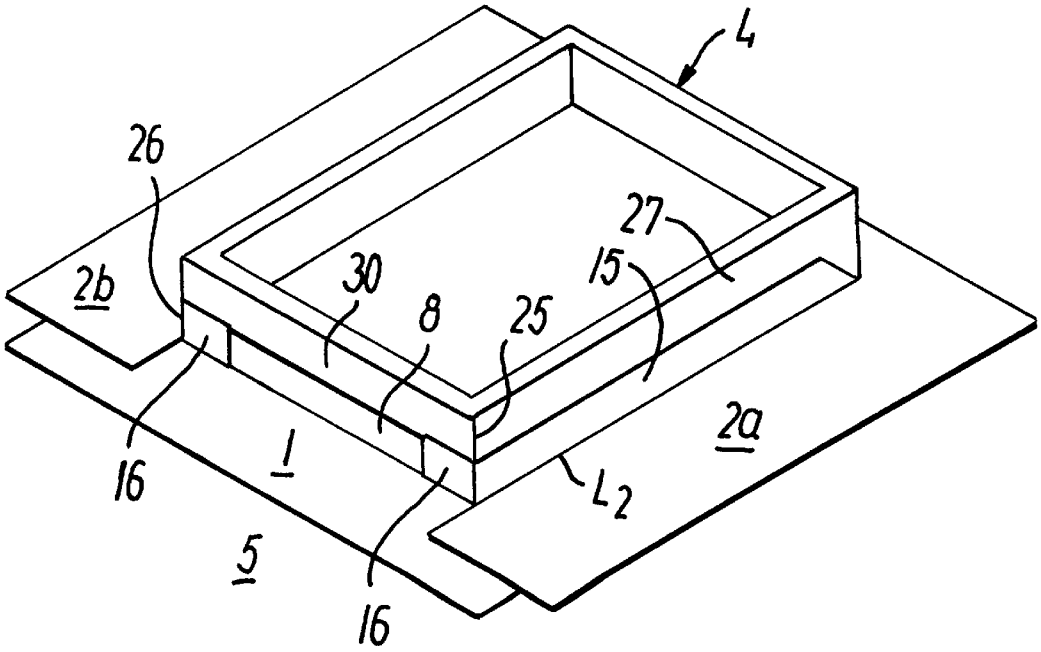
Figure 4:
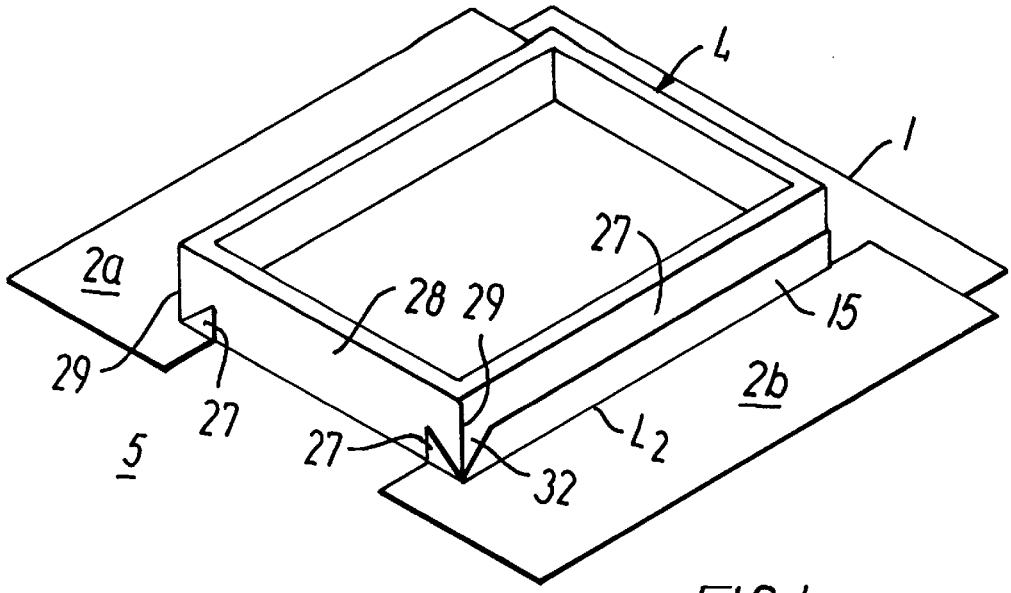

The mounting of the elements 1, 2*a*, 2*b*, 3 is carried out as follows:

The element 1 is placed as shown in FIG. 2. The length of the line segment $L_1$ is determined such that it is slightly larger than the width of the window frame 4, such that the end points of the line segment $L_1$ may get as close as possible to the corners 25, 26 of the window frame 4, regard being had to bending radii for the material of the element 1 at the line segment $L_1$ and the lines 10. The elongate flap 8 is fastened to the downwards facing side surface 30 of the window frame 4 and the side flaps 9 are fastened to each their respective one of the laterally facing side surfaces 27 of the window frame 4, for instance by means of nails, if the window frame 4 is made from a material which can receive nails, for instance wood. When the flaps 8, 9 are fastened and the element 1 thus fixated relative to the window frame, the remaining part of the element 1 is welded to the roof surface 5, the bitumen present on the under side of the element 1 being melted by a gas burner.

Then the elements 2*a* and 2*b* are mounted, the elongate flaps 15 being secured to the laterally facing side surfaces 27 of the window frame 4, and the side flaps 17 are fastened to the upwards facing side surface 28 of the window frame 4.

Just as the end points of the line segment $L_1$ may be brought quite close to the corners 25 and 26, as mentioned above, the upper end point of the line segment $L_2$ may due to the fastening by means of both the elongate flap 15 and the side flap 17 be brought close to the respective upper corner 29 of the window frame 4. The end flaps 16 are bent around the respective corners 25, 26 and are fastened to the downwards facing side surface 30 of the window frame 4, where they cover the triangular areas 31 of the downwards facing side surface 30, which at the ends of the elongate flap 8 is not covered thereby. The length of the line segment $L_2$ being slightly larger than the length of the laterally facing side surface 27 of the window frame 4, the lower end point of the line segment $L_2$ will be positioned slightly further down the roof surface 5 than the adjacent end point of the line segment $L_1$, and in this way it is ensured that water running down over the surface of the element 2*a*, 2*b* at the line segment $L_2$ will be conveyed further down the roof surface 5 via the surface of the element 1 and not down into the underlying roof structure. When the flaps 15, 16, 17 of the respective element 2*a*, 2*b* are fastened to the window frame 4, the remaining parts of the element 2*a*, 2*b* are welded to the roof surface 5.

Figure 5:
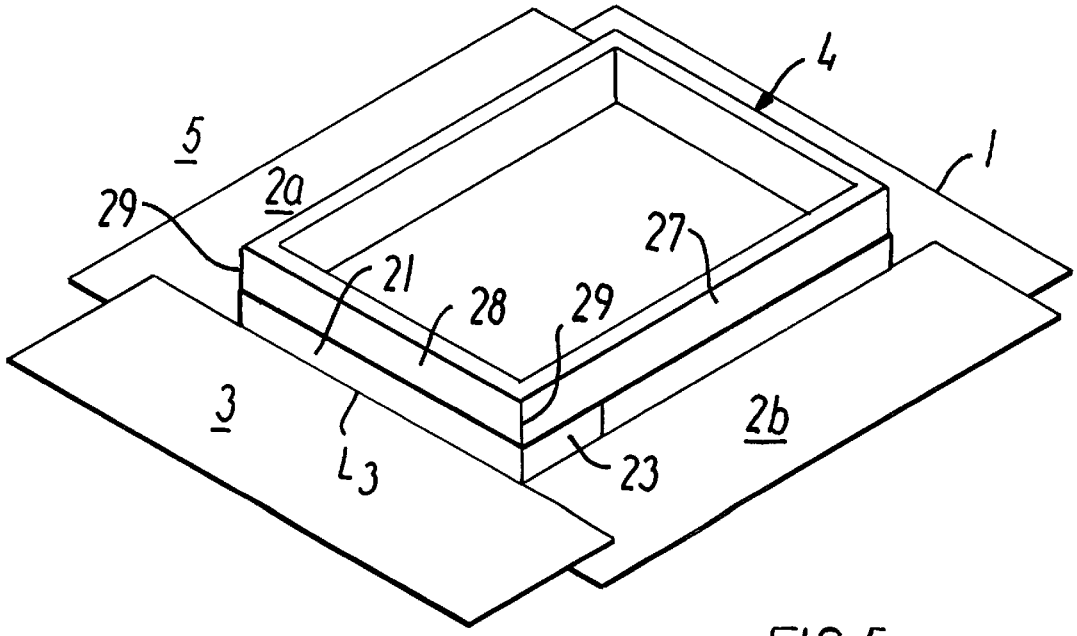

Finally, the elongate flap 21 of the element 3 is fastened to the upwards facing side surface 28 of the window frame 4, as shown in FIG. 5, and the end flaps 23 are bent around the corners 29 and fastened to the laterally facing side surfaces 27 of the window frame 4, where they cover the triangular areas 32 at the ends of the elongate flaps 15 which are not covered thereby. Then the remaining part of the element 3 is welded to the roof surface 5.

The length of the line segment $L_3$ being slightly larger than the width of the window frame 4, water running over the surface of the element 3 at the ends of the line segment $L_3$ will end on the element 2*a*, 2*b* in question farther away from the laterally facing side surface 27 of the window frame 4 than the adjacent end point of the respective line segment $L_2$, for which reason this water will run down over the surface of the element in question 2*a*, 2*b* and not penetrate into the underlying roof structure. From the element 2*a*, 2*b*, water will be conveyed across the element 1, as described above, and further down over the roof surface 5. After the mounting of the elements 1, 2*a*, 2*b*, a rail of a type known per se may be mounted on the upwards facing edge of the window frame 4, said rail preventing water from being conveyed down along the side surfaces 27, 28, 30 above the elongate flaps 8, 15, 21 and down behind them.

As mentioned, the angles $V_1$ and $V_{21}$ are approximately 45°, but they only have to be acute. They should, however, not be too close to 0 or 90°, as in the first case the triangular areas 31, 32, respectively, will become very large, which requires correspondingly long end flaps 16, 23, respectively, and the side flaps 9, 17, respectively, become very long and have to be shortened, whereas in latter case the side flaps 9, 17, respectively, become too small to ensure a good fastening. The angles $V_{22}$ and $V_3$ are straight (180°). If these angles become substantially smaller, the end flaps 16, 23, respectively, will not be able to cover the triangular areas 31, 32, respectively, in an adequate manner, and if they become substantially bigger, the mounting is made difficult, the result not having, however, necessarily to be leakage. The final dimensions of the elements 1, 2*a*, 2*b*, 3 are determined on basis of requirements to overlapping, said requirements being normally stipulated by the manufacturer of the roofing felt in question.

Figure 6:
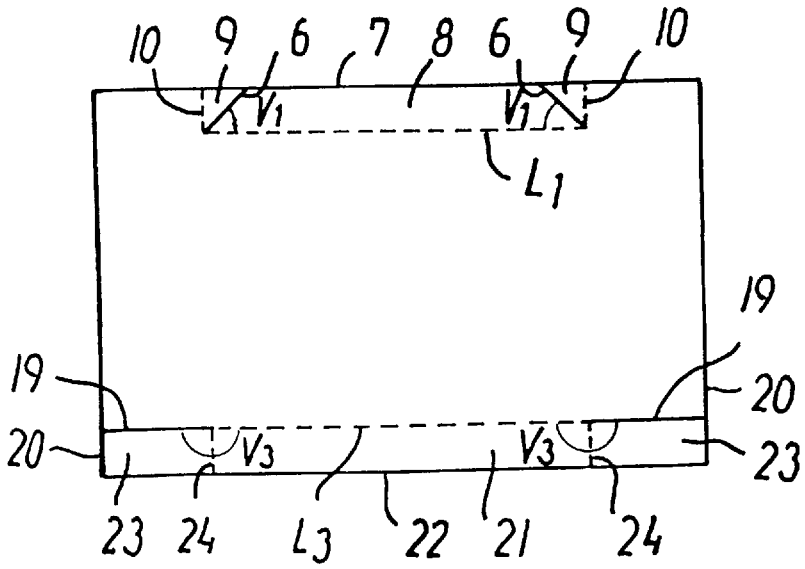

FIG. 6 shows an element 1' which at its upper side is provided with the same cuts and lines present in the element 1, and which at its lower side is provided with the same cuts and lines present in the element 3. This element 1' may be used between two windows which are placed closely together, one above the other.

Figure 7:
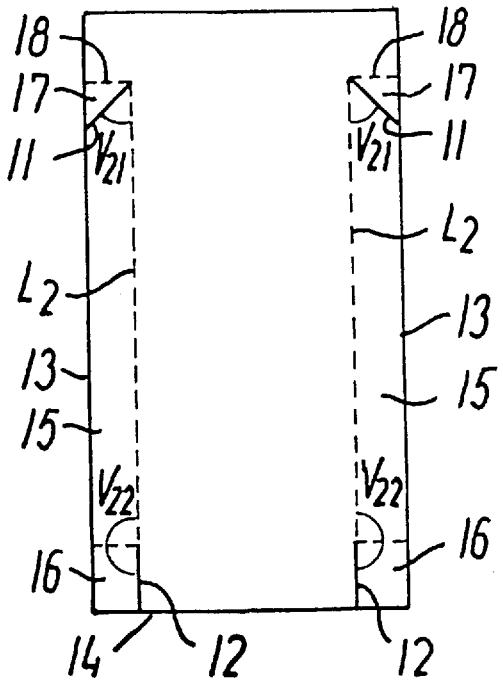

In a similar way, FIG. 7 shows an element 2*c* which at its left side is provided with the same cuts and lines present in the element 2*a*, and which at its right side is provided with the same cuts and lines present in the element 2*b*. This element 2*c* may be used between two windows which are placed closely together side by side.

What is claimed is:

1. A kit of elements of sheet material for flashing a quadrangular roof-penetrating element in an inclined roof (5) with a substantially plane surface, which material comprises one side suited for fastening to the roof surface and a second weather-proof side, comprising:

a first element (1) having at least one edge, a first line segment having ends, and two through cuts (6) extending convergingly from the ends of the first line segment (L1) to said one edge (7) of the first element (1);

a second element (2*a*) having first and second edges that extend at an angle relative to one another, a second line segment having first and second ends, and two through cuts (11, 12), one of the through cuts of the second element extending from the first end of the second line segment (L2) obliquely to the first edge (13) of the second element (2*a*) to define an acute angle (V21) with the second line segment (L2), and the other of the through cuts of the second element extending one of a) obliquely and b) straight to the second edge (14) of the second element (2*a*) to define one of an obtuse angle and a straight angle (V22) with the second line segment (L2);

a third element (2*b*) having edges, a third line segment, and through cuts that are mirror-inverted relative to the second element (2*a*); and a fourth element (3) having opposite edges, a fourth line segment having ends, and two through cuts (19), each through cut of the fourth element extending from a respective end of the fourth line segment (L3) to a respective edge (20) of the fourth element (3) to define one of an obtuse and a straight angle (V3) with the fourth line segment (L3).

2. A kit of elements according to claim 1, characterized in that the four elements (1, 2*a*, 2*b*, 3) are rectangular.

3. A kit of elements according to claim 1, characterized in that at least one of the first, second, third, and fourth elements (1; 2*a*; 2*b*; 3) is divided transversely to its respective line segment (L1; L2; L3) to define overlapping elements.

4. A kit of elements according to claim 1 characterized in that said acute angles ($V_1$, $V_{21}$) are approximately 45°.

5. A kit of elements according to claim 1, wherein the first and fourth elements are integral with one another to define a combined element, a first portion of which constitutes the first element, and a second portion of which constitutes the fourth element.

6. A method for flashing a quadrangular roof penetrating element having top, bottom, left, and right facing side surfaces in an inclined roof (5) with a substantially plane surface by means of a kit of elements of sheet material, which material comprises one side suited for fastening to the roof surface and a second water-proof side, the kit of elements including a first element (1) having at least one edge, a first line segment having ends, and two through cuts (6) extending convergingly from the ends of the first line segment (L1) to said one edge (7) of the first element (1);

a second element (2*a*) having first and second edges that extend at an angle relative to one another, a second line segment having first and second ends, and two through cuts (11, 12), one of the through cuts of the second element extending from the first end of the second line segment (L2) obliquely to the first edge (13) of the second element (2*a*) to define an acute angle (V21) with the second line segment (L2), and the other of the through cuts of the second element extending one of a) obliquely and b) straight to the second edge (14) of the second element (2*a*) to define one of a) an obtuse angle and b) a straight angle (V22) with the second line segment (L2);

a third element (2*b*) having first and second edges that extend at an angle relative to one another, a third line segment having first and second ends, and two through cuts, one of the through cuts of the third element extending from the first end of the third line segment obliquely to the first edge of the third element to define an acute angle with the third line segment; and the other of the through cuts of the third element extending one of obliquely and straight to the second edge of the third element to define one of an a) obtuse angle and b) a straight angle with the third line segment, a fourth element (3) having opposite first and second edges, at least one third edge that extends at an angle relative to said first and second edges, a fourth line segment having first and second ends, and two through cuts (19), each through cut of the fourth element extending from a respective end of the fourth line segment (L3) to a respective opposite edge (20) of the fourth element (3) to define one of an obtuse and straight angle (V3) with the fourth line segment (L3), the method comprising:

bending the first element (1) along the first line segment (L1) and along lines (10) extending at 90° from the ends of the first line segment (L1) to said one edge of the first element to define upwardly bent portions and remaining portions, said upwardly bent portions having at least a first section defined between cuts extending convergingly;

securing the upwardly bent portions (8, 9) to upwardly extending side surfaces (30, 27) of the roof-penetrating elements (4) by securing the first section of the upwardly bent portion of the first element to the bottom facing side surface (30) of the roof penetrating elements;

securing the remaining portions of the first element (1) to the roof surface (5);

bending the second element (2*a*) along the second line segment (L2), along a line (18) extending at 90° from the first end of the second line segment (L2) to said first edge of the second element, and along a line extending at 90° from the second end of the second line segment to said first edge of the second element, said bending defining upwardly bent portions and remaining portions, said upwardly bent portions having a first section and a second section, said first section defined along the second line segment and having upper and lower ends, said second section defined by the line extending at 90° from the first end of the second line segment to said first edge of the second element and said one of the through cuts of the second element;

securing the upwardly bent portions (15, 17) to the side surfaces of the roof penetrating element (4) by securing the upper end of the first section of the upwardly bent portions of the second element to the right facing side surface of the roof penetrating element, by securing the second section of the upwardly bent portions of the second element to the top facing side surface of the roof penetrating element, and by securing the lower end of the first section of the upwardly bent portions of the second element to the bottom facing side surface of the roof penetrating element, securing the remaining portions of the second element to the roof surface (5);

bending the third element (2*b*) along the third line segment, along a line extending at 90° from the first end of the third line segment to said first edge of the third element, and along a line extending at 90° from the second end of the third line segment to said first edge of the third element, said bending defining upwardly bent portions and remaining portions, said upwardly bent portions of the third element having a first section and a second section, said first section of the third element defined along the third line segment and having upper and lower ends, said second section of the third element defined by the line extending at 90° from the third line segment to the first edge of the third element and said one of the through cuts of the third element;

securing the upwardly bent portions of the third element to the side surfaces of the roof penetrating element by securing the upper end of the first section of the upwardly bent portions of the third element to the left facing side surface of the roof penetrating element, by securing the second section of the upwardly bent portions of the third element to the top facing side surface of the roof penetrating element, and by securing the lower end of the first section of the third element to the bottom facing side surface of the roof penetrating element;

securing the remaining portions of the third element to the roof surface (5);

bending the fourth element (3) along the fourth line segment (L3) to define upwardly bent portions and remaining portions, said upwardly bent portions of the fourth element having an left upwardly bent section, a right upwardly bent section, and a middle upwardly bent section, said left upwardly bent section of the fourth element defined by a line extending at 90° from the first end of the fourth line segment to the third edge of the fourth element and a line extending from the first end of the fourth line segment to the first edge of the fourth element, said right upwardly bent section of the fourth element defined by a line extending at 90° from the second end of the fourth line segment to the third edge of the fourth element and a line extending from the second end of the fourth line segment to the second edge of the fourth element, said middle upwardly bent section of the fourth element defined by the fourth line segment and said two through cuts of the fourth element;

securing the upwardly bent portions (21) to the side surfaces of the roof penetrating element (4) by securing said left upwardly bent portion to said left facing side surface, by securing said right upwardly bent portion to said right facing side surface, and by securing said middle upwardly bent portion to said top facing side surface; and securing said remaining portions of the fourth element to the roof surface (5).

7. The method according to claim 6, wherein the roof surface is made of concrete, and wherein the remaining portions of the first element, the remaining portions of the second element, the remaining portions of the third element, and the remaining portions of the fourth element are secured directly to the concrete roof surface.

8. A kit of elements according to claim 1, wherein the second and third elements are integral with one another to define a combined element, a first portion of which constitutes the second element and a second portion of which constitutes the third element.

* * * * *